US007607796B2

(12) United States Patent
Meyer

(10) Patent No.: US 7,607,796 B2
(45) Date of Patent: Oct. 27, 2009

(54) HOUSING COMPRISING AN INVISIBLE STIFFENER

(75) Inventor: Yves Meyer, Rixheim (FR)

(73) Assignee: Normalu, Kembs (FR)

( * ) Notice: Subject to any disclaimer, the term of this patent is extended or adjusted under 35 U.S.C. 154(b) by 0 days.

(21) Appl. No.: 11/816,995

(22) PCT Filed: Feb. 23, 2006

(86) PCT No.: PCT/FR2006/000416

§ 371 (c)(1),
(2), (4) Date: Aug. 23, 2007

(87) PCT Pub. No.: WO2006/090068

PCT Pub. Date: Aug. 31, 2006

(65) Prior Publication Data

US 2008/0151558 A1 Jun. 26, 2008

(30) Foreign Application Priority Data

Feb. 25, 2005 (FR) ..... 05 01947

(51) Int. Cl.
*F21S 4/00* (2006.01)

(52) U.S. Cl. ..... 362/223; 362/147; 362/225; 362/374

(58) Field of Classification Search ..... 362/147, 362/223, 224, 225, 282, 319, 323, 364, 365, 362/374, 375, 404, 408
See application file for complete search history.

(56) References Cited

U.S. PATENT DOCUMENTS

| | | | | |
|---|---|---|---|---|
| 3,142,447 | A * | 7/1964 | Bodian | 362/375 |
| 3,720,432 | A * | 3/1973 | Chudler | 362/374 |
| 3,760,178 | A * | 9/1973 | Miller | 362/223 |
| 4,910,650 | A * | 3/1990 | Goralnik | 362/147 |
| 2005/0157498 | A1 | 7/2005 | Dicken | |

FOREIGN PATENT DOCUMENTS

| | | |
|---|---|---|
| DE | 3834137 | 4/1990 |
| DE | 102 53 343 | 5/2004 |
| GB | 2117427 | 12/1983 |
| WO | 99/43907 | 9/1999 |
| WO | 03/071182 | 8/2003 |

* cited by examiner

*Primary Examiner*—Y My Quach Lee
(74) *Attorney, Agent, or Firm*—Young & Thompson

(57) ABSTRACT

A light housing which, together with other same-type housings, is intended to form a lighting wall, such as a ceiling. The housing includes a frame having at least one transparent or translucent panel (9) fixed to the base thereof and can receive lighting elements (3) which are disposed above the frame. The light housing is characterized in that it includes stiffening members (10, 10') which provide a link between certain sides (1*a*) of the frame, the stiffening members (10) being disposed close to the above-mentioned lighting elements (3).

19 Claims, 3 Drawing Sheets

HOUSING COMPRISING AN INVISIBLE STIFFENER

BACKGROUND OF THE INVENTION

This present invention concerns a light box of the type that is composed of an extruded channel element which is cut and assembled in the form of a frame, at the base of which is fixed a translucent sheet, with this light box being in particular intended to be placed alongside light boxes of the same type, so as to constitute a lighting matrix.

DESCRIPTION OF THE RELATED ART

It is known that light boxes of this type, when they are of small size, are sufficiently rigid to allow a user to handle them with no risk that they will suffer irreversible damage. Regrettably, the same cannot be said when the dimensions of these light boxes exceed certain limits, in which case one is obliged to reinforce them with stiffening elements. The latter are usually composed of transverse bars, making a connection in particular between two respective opposite sides of the light box, which lie more-or-less in the plane of the upper face of the latter, between the translucent sheet and the lighting means, so that the latter project shadows onto the translucent sheet, so that this shadow is visible to the occupants in the location.

SUMMARY OF THE INVENTION

One objective of this present invention is to propose a means which can be used to make up a stiffened light box that generates no shadow on the translucent sheet.

It has also been observed that the light boxes of this type all present, to various degrees, problems regarding servicing and maintenance of the lighting elements with which they are associated, in particular because of the fixing means with which they are fitted.

One is familiar therefore with light boxes that are held to the ceiling by screws placed around their periphery, so that one is obliged to execute a veritable dismantling operation in order to gain access to the translucent sheet and to the lighting means, followed by a re-fitting operation after maintenance work has been completed.

Some light boxes are also positioned so that they rest upon longitudinal and transverse supports held at a distance from the ceiling by tie-rods. It can be seen that in these conditions, maintenance on such light boxes is a difficult operation because of the complexity of executing the removal and refitting operations.

This present invention also has as its objective to overcome this drawback by proposing a light box that is able to provide the user with virtually immediate access to its internal volume, thus enabling easy and rapid maintenance both of the internal face of the translucent sheet and. the lighting means.

The subject of this present invention is therefore a light box which is intended, in particular in association with other light boxes of the same type, to constitute a luminous wall such as a ceiling for example, where this light box is composed of a frame, at the base of which is fixed at least one transparent or translucent sheet, and which is designed to receive lighting means positioned above the said frame, characterised in that it includes stiffening means comprising a connection between some of the sides of the frame, with these stiffening means being located close to the light sources.

For example, the stiffening means can be composed of at least one stringer or length element joining together two opposite sides of the frame. These stiffening means, in particular when the lighting means are composed of tubes placed parallel to each other, more-or-less in the same plane, can be placed more-or-less in this same plane and preferably between two adjacent tubes.

The frame forming the basic structure of the light box of the invention can advantageously be formed by the association of sections created from an extruded channel element.

In order to allow both the sliding of the light box and its rotation in relation to the ceiling, the upper face of at least two opposite sides of the frame will be hollowed out with a groove that is designed to receive, by sliding action, a sliding element that is articulated so as to rotate on a part that is attached to a support structure, and the ceiling in particular.

BRIEF DESCRIPTION OF THE DRAWINGS

A description will now be given, by way of a non-limiting example, of one form of execution of this present invention, with reference to the appended drawing, in which:

FIGS. 1 to 3 show a light box 1 according to the invention, which is positioned below a ceiling 2 on which are placed lighting means composed of parallel discharge tubes 3 for example. The light box 1, which is of parallelepiped form, is composed of the association of four extruded channel elements $\mathbf{1}_a$ that form each of its sides, and that end in 90° miter cuts connected by brackets that are not shown on the drawing. The lower part of the extruded channel, forming each of the sides, end in two parallel wings 4 and 5 extending downwards, and in which the inner face of the external wing 4 is equipped with a transverse stop element 6 intended to act as a simple support for one end of an edge element 7, placed on the periphery of translucent stretched sheet element 9 forming the bottom of the light box.

Figure 1:
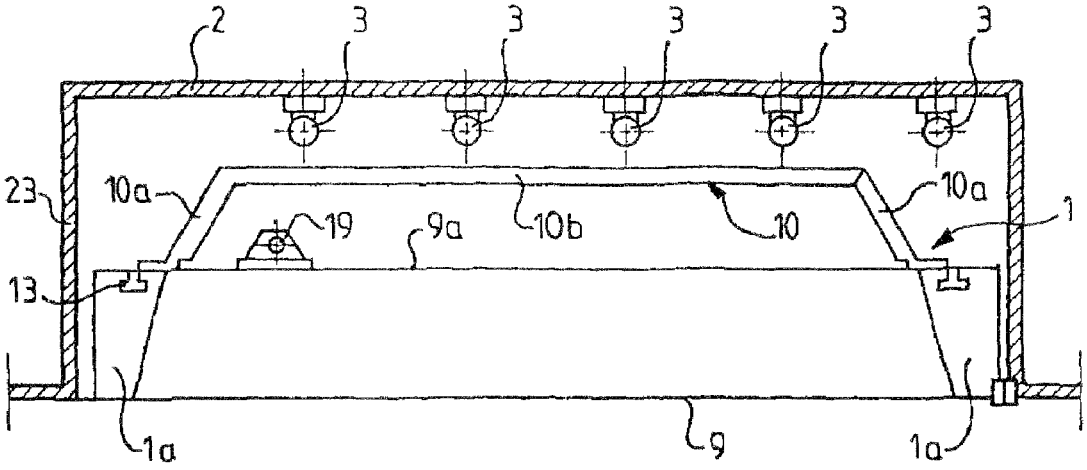
FIG. 1 is a view in vertical section of one method of implementation of a light box of the invention, shown in the closed or working position.

The latter is fitted with a stiffening element 10 joining two opposite sides $\mathbf{1}_a$ of the frame.

This stiffening element 10 is composed of a central part $\mathbf{10}_b$ that is parallel to the bottom of the light box 1 composed of the stretched sheet element 9, and two end parts $\mathbf{10}_a$ which are used to distance the central part $\mathbf{10}_b$ from the frame and to place it close to lighting means 3. It can then be seen that when the central part $\mathbf{10}_b$ of the stiffener 10 is located firstly at a distance from the entry face $\mathbf{9}_a$ of the light box, meaning from the large face of the latter opposite to the sheet, and secondly close to the lighting elements 3, the latter does not project a shadow of the stiffening element 10 onto the inner face of the translucent sheet element 9 forming the bottom of the light box.

Figure 2:
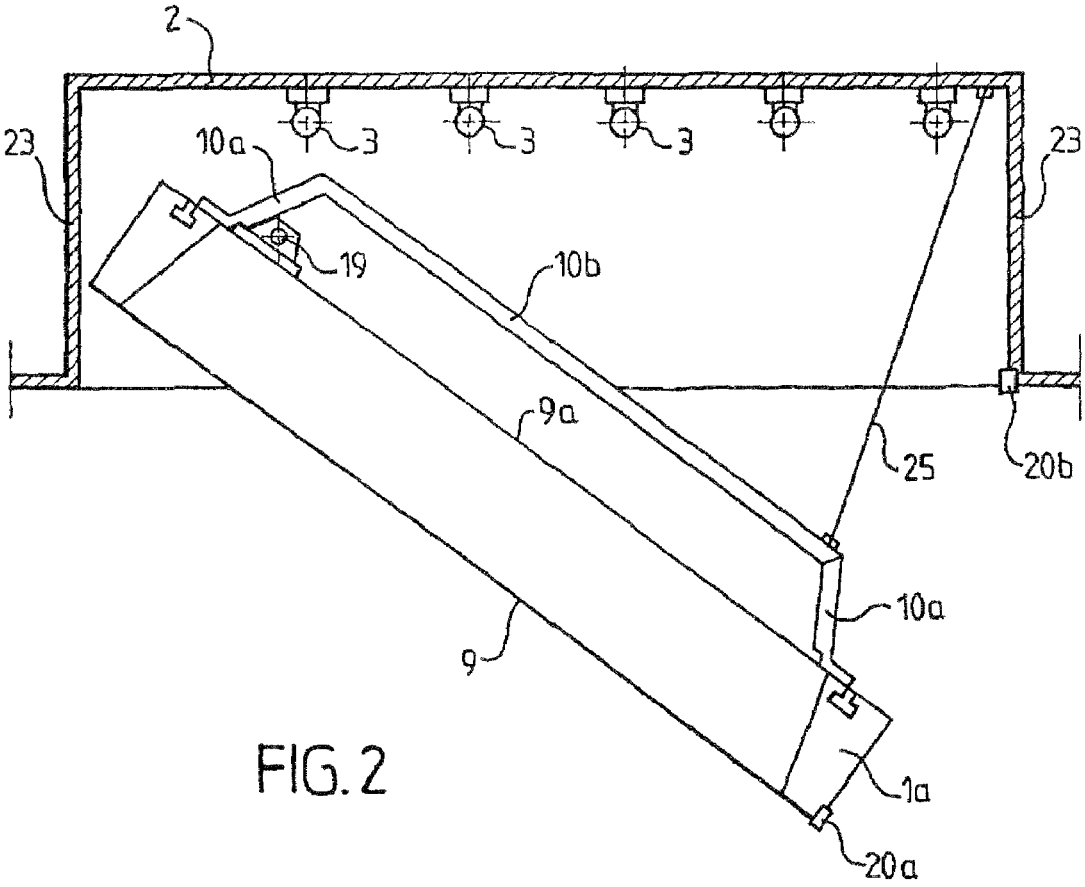
FIG. 2 is a view in vertical section of the light box shown in FIG. 1, in the open or maintenance position.
Figure 3:
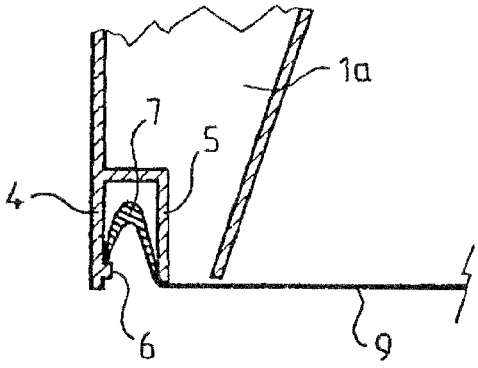
FIG. 3 is a partial view of the lower part of a light box of the type shown in FIGS. 1 and 2.
Figure 4:
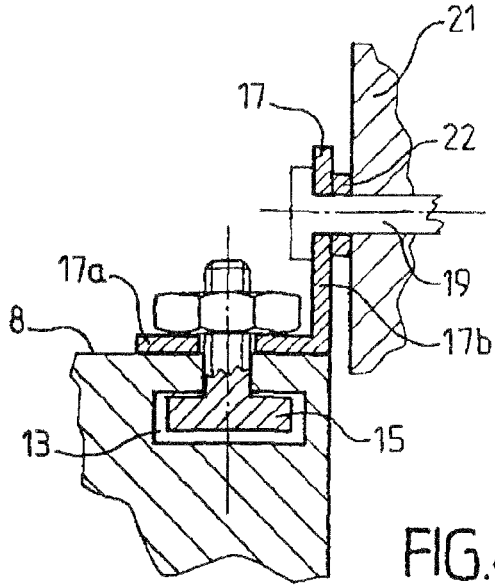
FIG. 4 is a partial view of the sliding and articulation means of the light box shown in the previous figures.

Furthermore, and in order to facilitate the maintenance operations, both on the inner face of the stretched sheet element (cleaning) and on the lighting means (cleaning and changing the fluorescent tubes), the light box of the invention is mounted to pivot around an axis located parallel to one of its sides. Advantageously, to this end, as shown in FIG. 4, the top edge 8 of each of the extruded channel elements $\mathbf{1}_a$ forming the sides of the light box is hollowed out into a groove 13 in the shape of an inverter T, which allows a sliding element 15 to slide in the latter. The light box of the invention is thus fitted respectively with two sliding elements placed in the top grooves of two opposite sides which are attached to the respective upper parts of a wing 17*a* belonging to a retention element 17 in the form of a bracket whose other wing 17*b* is traversed by a bolt 19 fixed into a side wall 21, with the interposition of a washer 22. In these conditions, it can be seen that the user has the ability to pivot the light box around the securing bolt 19 and, in order to allow the release of the latter when, as shown in FIGS. 1 and 2, it is enclosed in enclosure elements 23, he is able to slide it on the sliding element 15 hinged around the retention bolt 19.

Figure 5:
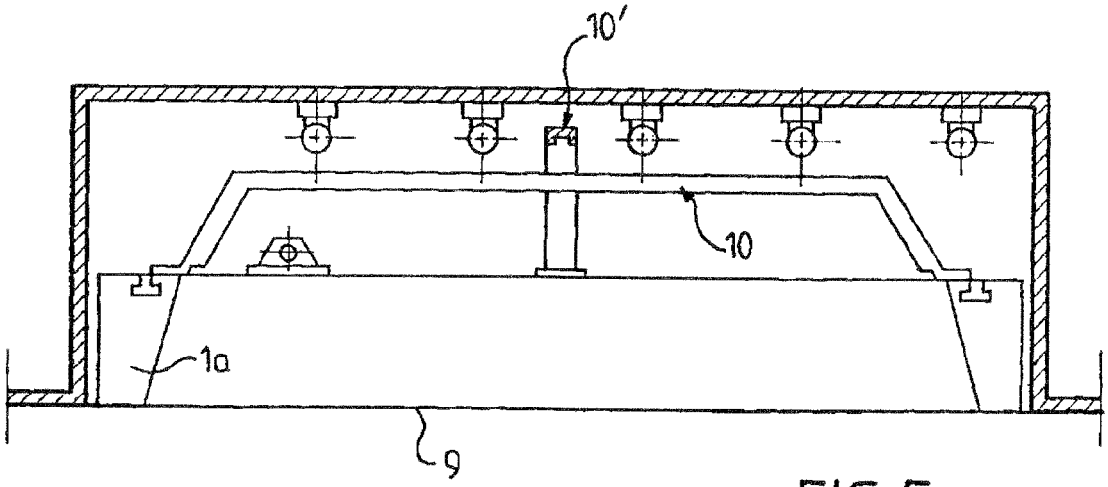
FIGS. 5 and 6 are partial views in vertical section of two implementation variants of the invention.

As shown in FIG. 5, in a particularly useful variant of the invention, the stiffening element can be placed parallel to the lighting tubes 3 and can even be placed between the latter.

Naturally, it is possible on a given light box, and in particular when the latter is of substantial dimensions, to make use of several stiffening elements and in particular of two perpendiculars stiffening elements 10, 10' as shown in FIG. 5.

In particular, the light box of the invention is intended to be fitted into a enclosure element 23. In such a method of implementation, the light box is usually held in its working position at four points. Two securing points are composed of the two bolts 19 and the sliding element 15, and the two other are composed of fixing latches formed from two elements 20*a*, 20*b* attached to the light box 1 and the enclosure element 23 respectively.

The light box also includes means that are used to secure it in an inclined position, as shown in FIG. 2, if the user so wishes. For example, these means can be composed simply of a flexible wire 25, a strap or a small chain, one end of which is fixed onto one end of element 10*b*, for example, and the other end on the enclosure element 23. These retention means are particularly useful, in that they constitute a means to ensure the safety of the user while opening the unit.

Figure 6:
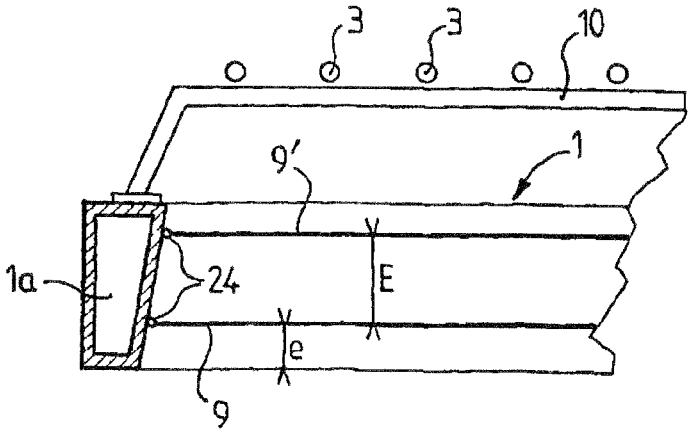

According to the invention, it is naturally possible to have several transparent and/or translucent sheets in the light box. Thus, in the method of implementation shown in FIG. 6, a light box 1 contains a first translucent sheet 9 at a distance "e" from the base of the latter, and a second transparent sheet 9' at a distance "E", above the first. In this implementation, the role of the upper sheet 9' is to protect the lower sheet 9' against any dust and insects that may be deposited on the latter and that may be visible to the occupants of the illuminated area. Sheets 9 and 9' can be secured by any means available and in particular by a spots of glue or spot welds 24 positioned around the periphery of the latter.

Preferably, the lighting means will be set away from the most distance sheet to leave a gap of at least ten centimetres.

Figure 7:
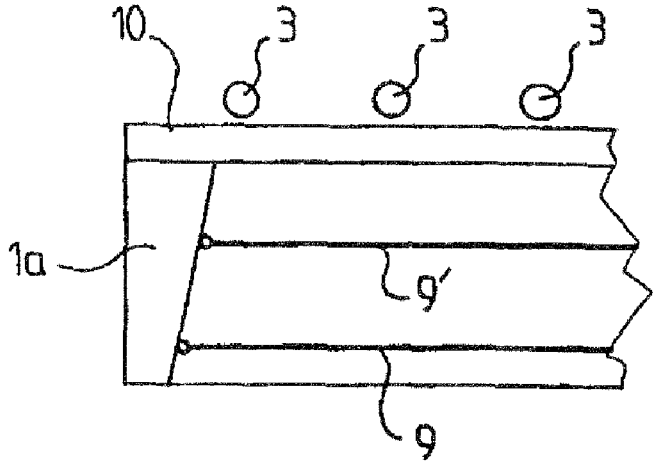
FIG. 7 is another variant in which the light box is of greater height, and the stiffening means are located in the upper plane of the latter.

Naturally, when the height of the light box is sufficient, as shown in FIG. 7, the stiffening means 10 can be placed in the plane of the upper part of the light box.

Figure 8:
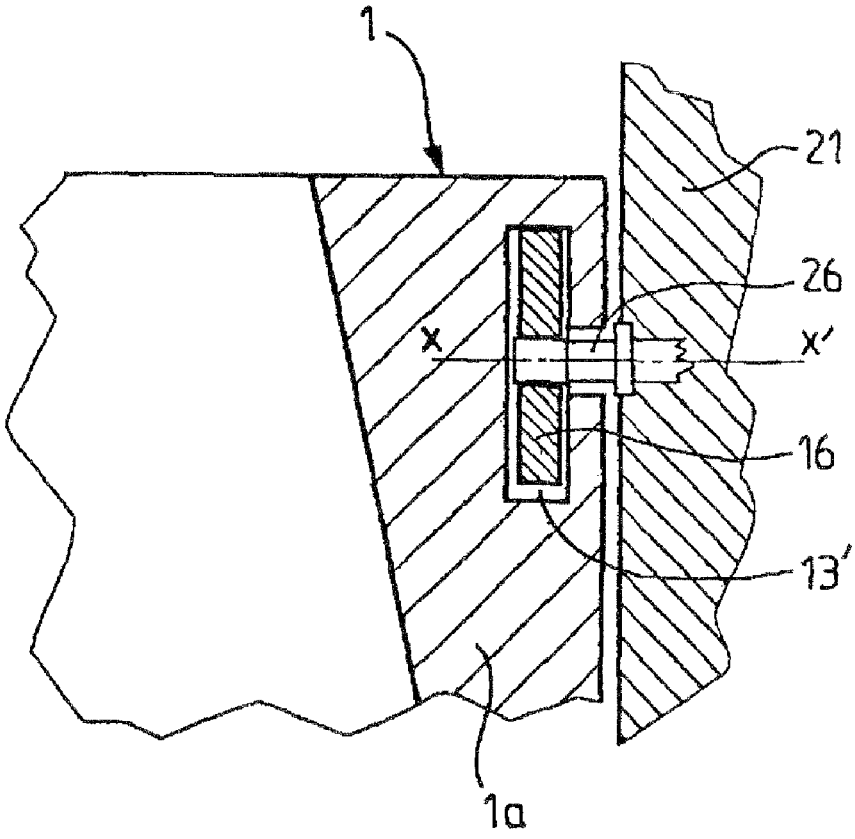
FIG. 8 is a partial view in vertical section of a variant of the sliding and articulation means of the light box shown in FIG. 4.

Furthermore, in order to improve the sliding action of the light box in relation to the housing, so as to facilitate the execution of maintenance operations, the latter can be equipped with rollers. As shown in FIG. 8, the extruded channel $\mathbf{1}_a$ from which the sides of the light box 1 are formed is hollowed out into a longitudinal groove 13' which is used to accommodate a roller 16 with a horizontal axis xx' around which a shaft 26, fixed to a side wall 21, is mounted to rotate.

Naturally, according to the invention, the groove could be replaced by a slide fixed on two opposite sides of the light box, either at the top or the sides of the latter.

The invention claimed is:

1. A light box, comprising:

a frame with a base, at least one transparent or translucent sheet (9) fixed at the base of the frame, stiffening means (10, 10') connecting between opposite sides of the frame, and lighting means, wherein, the frame and the stiffening means are located below the lighting means (3), with the stiffening means (10) located close to the lighting means (3), the stiffening means extends between the opposite sides of the frame at a position located vertically between the transparent or translucent sheet and the lighting means, the stiffening means extends across a lighting path of the lighting means at the position located vertically between the transparent or translucent sheet and the lighting means, and a central part ($\mathbf{10}_b$) of the stiffening means is located within the lighting path of the lighting means at a first vertical distance above the transparent or translucent sheet and at a second vertical distance below the lighting means such that, with the lighting means lighting the transparent or translucent sheet, the lighting means does not project a shadow of the stiffening means onto an inner face of the sheet element.

2. The light box according to claim 1, wherein the stiffening means is composed of at least one stringer or length element (10, 10') joining together two opposite sides (1*a*) of the frame, and the at least one stringer or length element (10, 10') is located vertically between the frame and the lighting means and the at least one stringer or length element (10, 10') extends across the lighting path of the lighting means.

3. The light box according to claim 1, wherein the lighting means are composed of tubes (3) placed parallel to each other approximately in the same plane.

4. The light box according to claim 3, wherein the stiffening means (10') is placed approximately in the same plane as the lighting tubes (3), and between two adjacent lighting tubes.

5. The light box according to claim 1, wherein the frame is formed by the association of sections, made up from a channel element.

6. The light box according to claim 1, wherein the frame comprises means that are designed to hold the frame open, and which is composed of a flexible wire (25), a strap or a small chain.

7. The light box according to claim 1, wherein the lighting means (3) are at least ten centimeters away from the transparent sheet (9).

8. The light box according to claim 2, wherein the lighting means are composed of tubes (3) placed parallel to each other approximately in the same plane.

9. The light box according to claim 8, wherein said stiffening means (10') is placed approximately in the same plane as the lighting tubes (3), and between two adjacent lighting tubes.

10. The light box according to claim 2, wherein the frame is formed by the association of sections, made up from an extruded channel element.

11. The light box according to claim 2, wherein the frame comprises, on each of the opposite sides (1*a*) of the frame a slide (13) that is designed to receive, by a sliding action, a sliding element (15) that is articulated to rotate on a part (19)

attached to a support structure, so as to allow the frame to both slide and rotate in relation to a ceiling.

12. The light box according to claim 11, wherein the slide is composed of a groove (13') hollowed out in the sides of the frame.

13. The light box according to claim 2, wherein the frame comprises means designed to hold the frame open.

14. The light box according to claim 2, wherein the lighting means (3) are at least ten centimeters away from the transparent sheet (9).

15. The light box according to claim 1, wherein the stiffening means is positioned so that the sheet (9) is free of any shadow of the stiffening means projected by the lighting means.

16. A light box, comprising:

a frame with a base, at least one transparent or translucent sheet (9) fixed at the base of the frame, stiffening means (10, 10') connected between sides of the frame, and lighting means the frame and the stiffening means located below the lighting means (3), with the stiffening means (10) located close to the lighting means (3), wherein the frame comprises, on each of opposite sides (1*a*) of the frame a slide (13) designed to receive, by a sliding action, a sliding element (15) that is articulated to rotate on a part (19) attached to a support structure, so as to allow the frame to both slide and rotate in relation to a ceiling.

17. The light box according to claim 16, wherein the slide is composed of a groove (13') hollowed out in the sides of the frame.

18. The light box according to claim 17, wherein the sliding element is composed of a wheel or roller (16) mounted to rotate around a horizontal axis (xx') attached to a wall (21).

19. A light box, comprising:

an enclosure element (23);

a frame with a base mounted in the enclosure element;

a transparent or translucent sheet (9) fixed at the base of the frame;, a stiffening element (10, 10') connected between sides of the frame; and lighting elements within the enclosure element and positioned above the frame and the stiffening element such that the sheet (9) is free of any shadow of the stiffening element projected by the lighting means, wherein the stiffening element is located approximately in the same plane as the lighting elements (3) and between two adjacent lighting elements.

* * * * *